US012686953B2

(12) United States Patent
Steinke et al.

(10) Patent No.: US 12,686,953 B2
(45) Date of Patent: Jul. 21, 2026

(54) THREAD PRODUCTION SYSTEM

(71) Applicant: STC SPINNZWIRN GMBH, Chemnitz (DE)

(72) Inventors: Peter Steinke, Leubsdorf (DE); Michael Schröter, Remscheid (DE); Marcel Ehrler, Mülsen (DE)

(73) Assignee: STC Spinnzwirn GmbH, Chemnitz (DE)

( * ) Notice: Subject to any disclaimer, the term of this patent is extended or adjusted under 35 U.S.C. 154(b) by 151 days.

(21) Appl. No.: 18/553,669

(22) PCT Filed: Mar. 9, 2022

(86) PCT No.: PCT/IB2022/052099
§ 371 (c)(1),
(2) Date: Oct. 2, 2023

(87) PCT Pub. No.: WO2022/208199
PCT Pub. Date: Oct. 6, 2022

(65) Prior Publication Data

US 2024/0360592 A1 Oct. 31, 2024

(30) Foreign Application Priority Data

Mar. 30, 2021 (DE) ..... 10 2021 107 995.0

(51) Int. Cl.
*D01D 13/00* (2006.01)
*D01D 5/08* (2006.01)
*D02J 1/22* (2006.01)

(52) U.S. Cl.
CPC ..... *D01D 13/00* (2013.01); *D01D 5/08* (2013.01); *D02J 1/225* (2013.01)

(58) Field of Classification Search
CPC ..... D01D 13/00; D01D 5/08; D01D 13/02; D01D 10/02; D02J 1/225; D02J 1/22; D02J 13/005
See application file for complete search history.

(56) References Cited

U.S. PATENT DOCUMENTS 5,755,086 A * 5/1998 Halbheer ..... D02G 1/0266 57/328
6,120,715 A 9/2000 Weigend
(Continued)

FOREIGN PATENT DOCUMENTS

DE 19909073 A1 9/1999
DE 10120551 A1 10/2002
(Continued)

*Primary Examiner* — Abbas Rashid
*Assistant Examiner* — Caroline Beha
(74) *Attorney, Agent, or Firm* — Laurence A. Greenberg; Werner H. Stemer; Ralph E. Locher

(57) ABSTRACT

A thread production system has a workstation with, in each case one after another on a processing path, a melt-spinning device with multiple melt nozzles, a thread inlet section, an inlet godet roller pair located at the end of a thread inlet section, a thread drawing device with two hot godet roller pairs which are arranged on a drawing panel frame of the thread production system, and a one take-up reel. The free godet roller ends of a first hot godet roller pair of the thread drawing device on the processing path protrude into an identical first half space as free godet roller ends of the inlet godet roller pair. Here, a rotational axis of a first godet roller of the inlet godet roller pair on the processing path is oriented at an angle of from 0° to 45° with respect to the longitudinal orientation of the nozzle row.

5 Claims, 4 Drawing Sheets

(56) References Cited

U.S. PATENT DOCUMENTS

| | | | | |
|---|---|---|---|---|
| 2015/0218733 | A1* | 8/2015 | Stundl | D02J 1/22 264/103 |
| 2017/0072611 | A1* | 3/2017 | Stündl | D01D 5/22 |
| 2020/0340141 | A1* | 10/2020 | Stündl | B25J 15/0019 |

FOREIGN PATENT DOCUMENTS

| | | | | |
|---|---|---|---|---|
| DE | 102004039510 | A1 | 2/2006 | |
| DE | 102010015215 | A1 | 10/2011 | |
| DE | 102014017620 | A1 | 7/2015 | |
| DE | 102015016800 | A1 | 6/2017 | |
| DE | 102017011183 | A1 | 6/2019 | |
| DE | 102018001274 | A1 | 8/2019 | |
| WO | 2005052224 | A1 | 6/2005 | |
| WO | 2019030134 | A1 | 2/2019 | |
| WO | WO-2019025263 | A1 * | 2/2019 | D01D 10/02 |

* cited by examiner

THREAD PRODUCTION SYSTEM

FIELD AND BACKGROUND OF THE INVENTION

The present invention relates to a thread production system with at least one workstation which comprises, in each case one after another on a processing path, a melt-spinning device with multiple melt nozzles which are arranged in a longitudinal orientation of a nozzle row, a thread inlet section, an inlet godet roller pair located at the end of the thread inlet section, a thread drawing device with at least two hot godet roller pairs which are arranged on a drawing panel frame of the thread production system, and has at least one take-up reel, wherein free godet roller ends of a first hot godet roller pair of the thread drawing device on the processing path protrude into an identical first half space as free godet roller ends of the inlet godet roller pair, wherein a rotational axis of a first godet roller of the inlet godet roller pair on the processing path is oriented at an angle of from 0° to 45° with respect to the longitudinal orientation of the nozzle row.

Thread production systems for producing synthetic threads based on a melt-spinning process have a melt-spinning device with an extruder and a spinning head, which in turn has multiple melt nozzles which are arranged in a nozzle row. Hot plastic filaments are extruded from each of the melt nozzles.

The filaments formed by the melt nozzles, when they drop down, typically pass through a drop shaft as well as a filament treatment, in which the filaments are combined to form threads, for example by means of oiling. The individual threads then run into a thread inlet section in which they are combined to form a band-shaped thread sheet, the width orientation of which initially corresponds to the longitudinal orientation of the nozzle row. The thread inlet section is typically formed by a vertical machine wall, hereinafter referred to as the inlet section wall, before which the threads run along until they run onto an inlet godet roller pair located at a lower end of the thread inlet section.

The threads are pretensioned by the inlet godet roller pair. In addition, a decoupling of the melt-spinning process from a thread drawing and thread winding occurring downstream on the thread production system takes place through the inlet godet roller pair.

The thread drawing device following the inlet godet roller pair on the processing path typically has multiple heated godet roller pairs. The godet rollers that each protrude out of a retaining wall of the thread production system are usually driven by electric motor. Using these godet roller pairs, the threads are pulled off and stretched. The thread drawing devices known from the prior art frequently have an uppermost, less strongly heated godet roller pair for thread relaxation.

After the threads have passed through the thread drawing device, they are wound onto at least one take-up reel.

The threads pass through the majority of the thread production system as a flat, band-shaped thread sheet, which is guided over the godet rollers of the thread production system. Only after leaving the godet rollers are the threads wound individually onto the respective take-up reel.

In addition to the cylindrical godet roller casings, further cylindrical objects, such as rollers, rolls and rods, are therefore necessary for guiding, deflecting and supporting the band-shaped thread sheet in the thread production system.

As known, for example, from document DE 199 09 073 A1, the thread sheet is guided along the circumference of the godet roller casings of a godet roller pair for drawing, wherein the thread sheet wraps around the godet roller pair multiple times. During this repeated circulation of the thread sheet around the godet roller pair, the threads are heated by means of the heated godet rollers. Then, the thread sheet reaches a next godet roller pair at a higher rotational speed. Due to the higher rotational speed, the thread tension required for drawing is produced. The region between two such godet roller pairs arranged one after the other on the processing path thus forms a drawing zone in which the threads of the thread sheet are stretched.

Depending on which thread properties are sought, multiple drawing zones are occasionally provided between the heated godet roller pairs arranged one after the other on the processing path, in which the threads are stretched stepwise. Thus, in the production of threads, a good three or more hot godet roller pairs can be used for drawing the threads.

Usually, hot godet roller pairs heated differently are located in thermally insulating housings which have at least one slot through which the thread sheet can run onto the godet roller casing and a further slot through which the thread sheet can also run off.

Often, the thread production systems operating downstream of a melt-spinning process have multiple workstations, each having a melt-spinning device, a thread inlet section downstream of the melt-spinning device, a thread drawing device downstream of the thread inlet section, and a winding device downstream of the thread drawing device.

Such a generic apparatus for thread production is known, for example, from publication DE 10 2010 015 215 A1. Here, a pull-off device with multiple driven godet rollers and a take-up device with multiple winding points are provided per spinning unit and together form a workstation. Adjacent workstations are drivable independently of one another and each have a separate electrical supply. Furthermore, the pull-off device and the reel winding device are designed to be interchangeable independently of one another, as a result of which a rapid and safe startup of the pull-off and take-up devices of individual workstations is to be ensured.

In the event of a thread tear, the thread production in the workstation concerned must be interrupted. It is then the object of an operator to guide the threads again in the processing direction through or via the individual components of the entire thread production system before the thread production can be started again.

Even in the case of each initial start-up or a restart after a malfunction, after maintenance, after a cleaning of the godet roller casings or after a changeover, it is necessary for an operator to route the threads through the entire thread production system before the thread production can be put into motion again.

Efforts have therefore been made to improve the accessibility and exchangeability of individual components of a workstation of a thread production system in order to facilitate, for example, maintenance and/or cleaning work, or to increase the flexibility of the thread production system.

Document DE 10 2014 017 620 A1 discloses a device for pulling off and drawing synthetic threads with multiple godet roller units which are held on a frame wall. In order to facilitate the cleaning of the godet roller casings when the godet rollers are arranged as compactly as possible, at least one godet roller casing is axially displaceable on the frame wall in such a way that it can be transferred into a maintenance position that is projecting from adjacent godet roller casings.

Document DE 10 2017 011 183 A1 discloses a device for pulling off, drawing and taking up a synthetic thread sheet with multiple godet rollers arranged on a godet roller wall. The godet roller wall is held replaceably in a vertical opening of a machine frame, whereby an entire arrangement of multiple godet rollers can be exchanged at once.

Document DE 10 2018 001 274 A1 discloses a pull-off device in a melt-spinning process for guiding a thread sheet. The godet rollers of the pull-off device are designed as plug-in units and can be held in a plug-in connection on a retaining wall.

Document DE 10 2004 039 510 A1 discloses a device for melt-spinning, pulling off, treating and taking up of multiple synthetic threads. One example of this device has a spinning nozzle device with eight spinning nozzles arranged next to one another on a spinning beam. A cooling device with a cooling shaft is assigned to the spinning nozzles. Below, there is a preparation device in the preparation thread guides of which the filament sheets extruded from the spinning nozzles are each brought together to form a thread. Below the preparation device, two pull-off members are arranged with one godet roller each and one freely rotatable overflow roller. A drawing panel with two drawing godet roller duos adjoins the preparation device in the processing direction. After the drawing, the threads are each taken up on spools by a take-up device.

Document DE 101 20 551 A1 describes a device for melt-spinning and taking up a synthetic thread. The device has a machine frame on which a spinning device is arranged. The spinning device has a spinning head and a spinning nozzle arranged below the spinning head. The filament bundle produced by the spinning nozzle passes through a cooling device and is then brought together by a preparation device to form a thread. A delivery mechanism is arranged below the spinning device and is designed as a godet roller unit with a driven godet roller and a non-driven overflow roller. In one example, multiple treatment modules, which are arranged on a module receiving device, adjoin the delivery mechanism. The treatment modules each contain a godet roller duo. Following the treatment modules, the thread runs onto a further delivery mechanism which is arranged diagonally opposite the first delivery mechanism. The further delivery mechanism consists of a heated and an unheated godet roller, both of which are driven. The further delivery mechanism enables relaxation for shrinking the thread before the take-up device takes up the thread.

Document DE 10 2015 016 800 A1 also discloses a device for melt-spinning, pulling off, drawing, relaxing and taking up a synthetic thread. The device includes a spinning device with four spinning nozzles arranged on a spinning beam. The filament sheet extruded from the respective spinning nozzle passes through a cooling shaft and is then bundled to form a thread on a collection thread guide. By means of a comb thread guide, the threads are then brought to a distance with which they thereupon run onto a first pull-off godet roller of a pull-off device. The first pull-off godet roller duo comprises two pull-off godet rollers. The pull-off device comprises a second pull-off godet roller duo likewise with two pull-off godet rollers. From the last pull-off godet roller, the threads run onto a first drawing godet roller followed by further drawing godet rollers arranged one above the other. The drawing godet rollers are heated and arranged in a heating box. The threads wrap around the drawing godet rollers only once. The last drawing godet roller is followed in the processing direction by a heated relaxing godet roller with two likewise heated relaxing godet rollers. The device further comprises a take-up device which winds each of the threads onto a reel. The rotational axis of the first pull-off godet roller duo of the pull-off device is oriented in the longitudinal direction of the nozzle row comprising the four spinning nozzles.

In most cases, an improvement in the accessibility of individual components of the thread production system, in particular in order to carry out a cleaning or maintenance of the system, is achieved only at the cost of a compact design of the overall system. In order to be able to realize an accessible arrangement of the individual components of the thread production system at all, in current thread production systems the thread drawing device is typically arranged laterally next to the thread inlet section in such a way that a front of the inlet section, on which the threads run downwards in the direction of the inlet godet roller pair, looks into the same space direction half as free godet roller ends of the godet rollers of the thread drawing device. In order for the thread sheet to be able to run onto the godet rollers of the thread drawing device located next to it from the thread inlet section, it is therefore necessary in the current thread production systems to rotate the width orientation of the thread sheet at the end of the thread inlet section 90°. This is done, for example, by an inlet godet roller pair protruding perpendicularly from the thread inlet section. Such a side-by-side arrangement of thread inlet section and thread drawing device results in a very wide system, in which all thread-guiding components can only be reached from one side by an operator. The large dimensions in height and width complicate the operation and work on the system.

SUMMARY OF THE INVENTION

It is therefore the object of the present invention to propose a compact thread production system of the type specified at the outset with improved accessibility for a thread change and for the cleaning and maintenance thereof.

According to the invention, this object is solved by a thread production system with at least one workstation, which comprises, in each case one after the other on a processing path, a melt-spinning device with multiple melt nozzles arranged in longitudinal orientation of a nozzle row, a thread inlet section, an inlet godet roller pair located at the end of the thread inlet section, a thread drawing device with at least two hot godet roller pairs arranged on a drawing panel frame of the thread production system and at least one take-up reel, wherein free godet roller ends of a first hot godet roller pair of the thread drawing device on the processing path protrude into an identical first half space as free godet roller ends of the inlet godet roller pair, and wherein a rotational axis of a first godet roller of the inlet godet roller pair on the processing path is oriented at an angle of from 0° to 45° with respect to the longitudinal orientation of the nozzle row, wherein a heated relaxing godet roller pair is arranged on a relaxing frame arranged downstream of the drawing panel frame on the processing path, wherein a passage is formed between the drawing panel frame and the relaxing frame, and wherein free ends of the relaxing godet roller pair protrude into a second half space lying opposite the first half space.

The advantageous arrangement and orientation of the inlet godet roller pair improves accessibility for a thread change while maintaining a compact design of the overall workstation.

In the present invention, the thread sheet runs onto the inlet godet roller pair without being twisted by more than 45° in its width orientation. Particularly preferably, the thread sheet generated by the melt nozzles is not twisted at all when it is running onto the first godet roller of the inlet godet roller pair. Thus, an operator facing the thread inlet section can monitor both the downwardly running melt-spun threads and the winding around the godet rollers of the inlet godet roller pair and guide a thread over the inlet godet roller pair without it having to rotate or leave its position. The operator can also easily check whether the thread sheet is running properly, for example without vibrating, onto the inlet godet roller pair.

The thread sheet produced by the melt nozzles arranged in the longitudinal direction of the nozzle row can be picked up by an operator, for example with a suction gun, and can initially be guided around the godet rollers of the inlet godet roller pair which is located at the end of the thread inlet section. In this case, the rotational axis of the first godet roller of the inlet godet roller pair is oriented substantially parallel on the processing path, i.e., at an angle of from 0° to 45°, with respect to the longitudinal direction of the nozzle row in which the melt nozzles are arranged next to one another. As a result, the thread sheet extruded on the melt nozzles is twisted a maximum of 45° during the first winding onto the inlet godet roller pair. In this case, the thread sheet is preferably rotated less than 30°, in a particularly preferred manner not rotated at all, by the rotational axis of the first godet roller of the inlet godet roller pair being oriented less than 30° with respect to the longitudinal direction of the nozzle row, or parallel thereto.

On the processing path to the inlet godet roller pair, the thread sheet is then wrapped around the at least two hot godet roller pairs arranged on the drawing panel frame of the workstation. Free godet roller ends of the first hot godet roller pair of the thread drawing device on the processing path protrude into the same half space as the free godet roller ends of the inlet godet roller pair. Thus, the thread sheet runs into the thread drawing device of the thread production system without having been twisted by more than a total of 45° in its width orientation since the extrusion from the melt nozzles. Preferably, the thread sheet is rotated less than 30° at the inlet into the thread drawing device, in a particularly preferred manner not at all.

In order to facilitate the thread guiding and/or a thread change, it is advantageous if the thread sheet extruded at the melt nozzles is twisted in its width orientation as little as possible or even not at all during processing in a compact and easily accessible thread production system.

In the present invention, this is achieved by a heated relaxing godet roller pair being arranged on a relaxing frame arranged separately from the drawing panel frame on the processing path, wherein a passage is formed between the drawing panel frame and the relaxing frame, and wherein free ends of the relaxing godet roller pair protrude into a second half space lying opposite the first half space.

The thread drawing device comprises the additional heated relaxing godet roller pair, which is not arranged on the drawing panel frame, but on the separate relaxing frame, which is arranged on the processing path downstream of the drawing panel frame.

A passage is located between the relaxing frame and the drawing panel frame. An operator can stand on this passage and rotate and walk along this passage. From this passage, the operator has access to the drawing panel frame as well as to the relaxing frame, so that a thread change on the respective godet roller pairs of the drawing panel frame and the relaxing frame can be made particularly advantageously by the operator from the passage.

After the operator has wound the thread sheet around the inlet godet roller pair at the end of the thread inlet section, the operator can now in sequence guide the thread sheet around the at least two hot godet roller pairs of the drawing panel frame which connect directly to the inlet godet roller pair on the processing path. The passage between the drawing panel frame and the relaxing frame allows the operator sufficient clearance to be able to comfortably and safely guide the thread sheet along the processing path.

From the last hot godet roller pair of the drawing panel frame, the thread sheet can be guided beyond the passage to the relaxing godet roller pair.

Due to the fact that the free ends of the relaxing godet roller pair protrude into a second half space opposite the first half space, the free ends of the relaxing godet roller pair are directly accessible for the operator from the passage, so that the thread sheet can be easily and safely wrapped around the relaxing godet roller pair from the passage.

By attaching the relaxing godet roller pair to the separate relaxing frame, lower construction heights result for the relaxing frame and the drawing panel frame than if all godet roller pairs were provided on the same frame, which additionally improves the accessibility and operability of the hot godet roller pairs and the relaxing godet roller pair.

Furthermore, maintenance, cleaning and repair work on the hot godet roller pairs or the relaxing godet roller pair can be carried out safely and comfortably from the passage between the drawing panel frame and the relaxing frame.

Due to the fact that the free godet roller ends of the heated relaxing godet roller pair protrude into the second half space opposite the first half space, the drawing panel frame and the relaxing frame can be arranged in an overall compact arrangement on the workstation.

In addition to the relaxing godet roller pair, further devices for thread treatment, for example, at least one additional godet roller, roll, tangle nozzle, etc., can be arranged on the relaxing frame, so that a further treatment of the threads can take place there.

From the relaxing frame, the thread sheet continues to the at least one take-up reel, where the threads are wound up to form coils.

It has also been found to be advantageous if at least two hot godet roller pairs arranged directly one after the other on the processing path are arranged such that each of their free godet roller ends protrude into half spaces lying opposite one another.

Due to the fact that each of the free godet roller ends of the at least two hot godet roller pairs arranged directly one after the other on the processing path protrude into half spaces lying opposite one another, that is to say in space direction regions lying opposite one another, these at least two hot godet roller pairs can be mounted very compactly, but also very easily accessibly on the common drawing panel frame, which itself is preferably accessible from the two sides, on each of which the hot godet roller pairs are respectively fastened.

This particular arrangement is particularly advantageous both for a thread change and for cleaning and maintenance work on the hot godet roller pairs.

Until now, for the arrangement of hot godet roller pairs which are run through one after the other on the processing path, an offset results between the fastening planes, i.e., between those vertical planes in which a hot godet roller pair is fastened to a retaining wall. This is because the thread inlet region is located on a hot godet roller pair close to the drive ends of the godet roller casings, i.e., close to the retaining wall. With each thread run around the guide jackets of a godet roller pair, the thread sheet runs further in the direction of the free godet roller ends which are directed away from the retaining wall. For a straight thread routing during a transfer of the thread sheet to a next godet roller pair, the thread inlet region of the next godet roller pair must be arranged exactly above the thread runout region of the godet roller pair that was previously run around. This has hitherto only been possible by the fastening plane of the next godet roller pair being offset horizontally with respect to the fastening plane of the godet roller pair that was previously run around. The size of the offset is determined by the number of loops of the godet roller pair that was previously run around and the width of the thread sheet. In the case of a plurality of threads and a plurality of wrappings of a thread sheet around a godet roller pair, relatively large construction lengths are thus provided for the godet rollers protruding out of a retaining wall, which makes necessary a correspondingly large horizontal offset between the fastening planes of the godet roller pairs through which the thread sheet runs one after another.

This problem is solved in a further particularly advantageous embodiment of the invention by all of the hot godet roller pairs arranged on the drawing panel frame being arranged in such a way that the respective free godet roller ends of the hot godet roller pairs arranged directly one after the other on the processing path protrude into half spaces lying opposite one another.

This is advantageous when more than two hot godet roller pairs are to be arranged on the drawing panel frame.

If, for example, three hot godet roller pairs are arranged on the drawing panel frame, a first hot godet roller pair on the processing path protrudes into the same first half space as the inlet godet roller pair at the end of the thread inlet section. A hot godet roller pair which is second on the processing path and is likewise arranged on the drawing panel frame projects into a second half space opposite the first half space. The thread sheet can thus run perpendicularly from the free godet roller ends of the first hot godet roller pair and, close to the retaining wall of the second hot godet roller pair, run perpendicularly onto the godet roller casing of the first godet roller of the second hot godet roller pair. A third hot godet roller pair on the processing path, projects again into the same first half space as also the inlet godet roller pair and the first hot godet roller pair on the drawing panel frame.

In this advantageous arrangement, further hot godet roller pairs on the drawing panel frame with changing orientation of the free godet roller ends can be mounted particularly compactly and with easy accessibility on the drawing panel frame.

In another, likewise advantageous embodiment of the invention, the lower of the hot godet roller pairs on the drawing panel frame, as described above, are oriented with respectively alternating orientation of their free godet roller ends and, only in the case of a top hot godet roller pair of the drawing panel frame, the free godet roller ends thereof protrude into the same half space as the free godet roller ends of a hot godet roller pair arranged underneath, wherein the uppermost hot godet roller pair protrudes by at least half of a godet roller casing length of one of its godet rollers beyond the free godet roller ends of the hot godet roller pair arranged underneath into the respective, same half space.

In this embodiment of the invention, the drawing panel frame is expanded around the uppermost hot godet roller pair, the free godet roller ends of which protrude into the same half space as the hot godet roller pair arranged underneath. The optional uppermost hot godet roller pair arranged in this way increases the flexibility of the thread production system to the effect that it is possible to produce different threads on a workstation of the thread production system without the need for changeover at the workstation.

The uppermost hot godet roller pair can optionally be used in the production of threads by wrapping the thread sheet around it when it is loaded. If the uppermost hot godet roller pair is not required during the production of a specific thread type, it can be omitted when the thread sheet is loaded. Due to the arrangement of the uppermost hot godet roller pair relative to the hot godet roller pair located underneath, the thread guide is not impaired if the uppermost hot godet roller pair remains free when the thread sheet is loaded.

As a result, in this embodiment of the invention, the number of hot godet roller pairs within the thread drawing device can be optionally increased or reduced by one solely by the loading of the thread sheet. A changeover of individual components of the thread production system is not necessary in this context.

It proves to be particularly advantageous if the inlet godet roller pair is fastened to a drive module arranged underneath and at least partially in front of the thread inlet section.

This arrangement of the inlet godet roller pair makes it possible for the thread sheet to run downward at the bottom of the thread inlet section, preferably perpendicularly, and then, without being twisted, to be loaded on the circumference of a godet roller casing of the first godet roller of the inlet godet roller pair on the processing path. Thus, the thread sheet is pulled off perpendicularly and untwisted from the first godet roller of the inlet godet roller pair through the thread inlet section.

Especially preferred embodiments of the present invention, their structure, function and advantages are explained in more detail below with reference to figures, wherein:

DETAILED DESCRIPTION OF THE INVENTION

In all figures, the illustrated embodiment of the invention or details thereof are not necessarily shown to scale.

Figure 1:
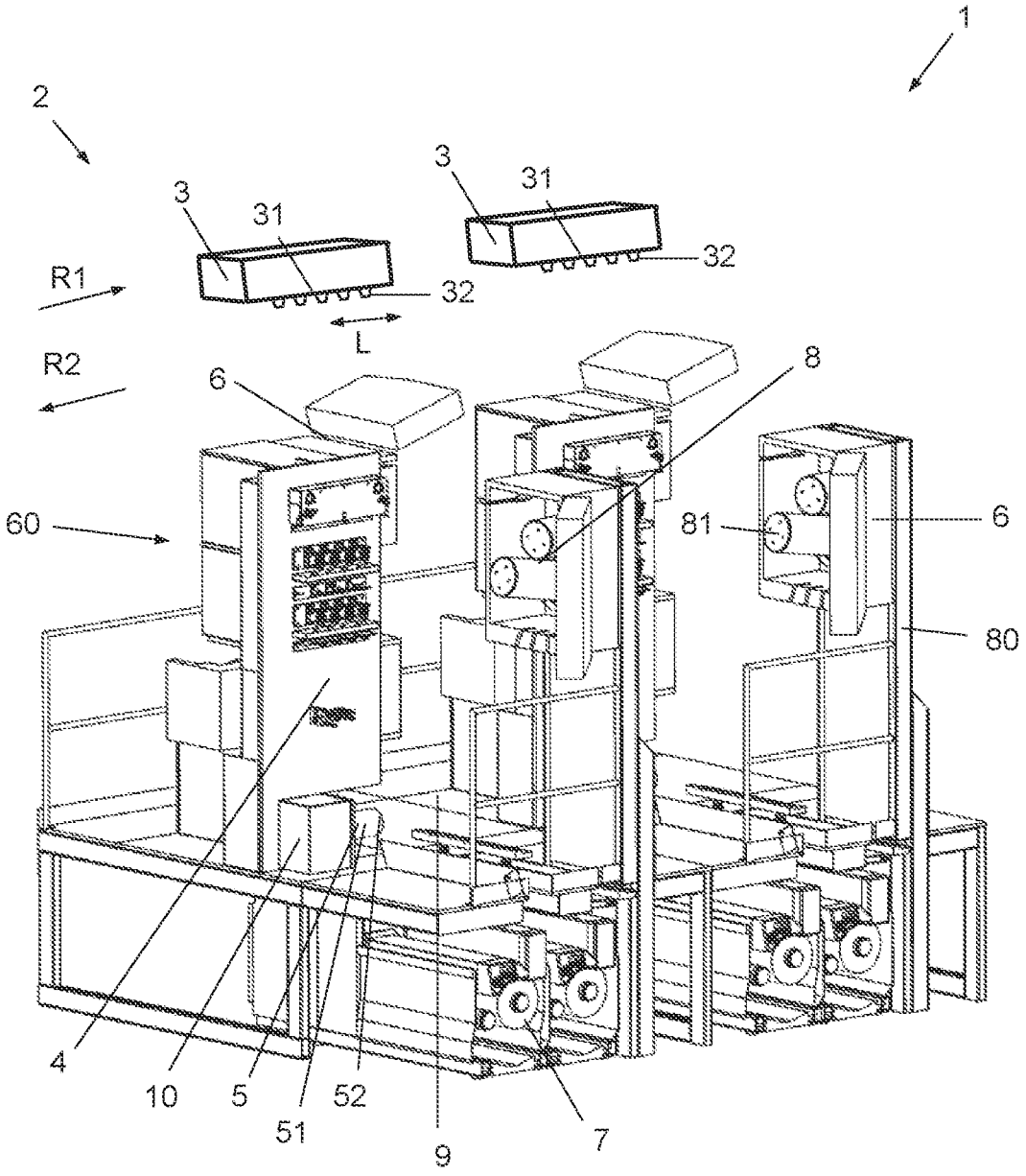
FIG. 1 schematically shows a possible embodiment of a thread production system according to the invention with two workstations in a front view.

FIG. 1 shows an embodiment of a thread production system 1 according to the invention with two workstations 2 arranged next to one another. Each of the workstations 2 has a melt-spinning device 3, a thread inlet section 4 adjoining it, an inlet godet roller pair 5 located at the end of the thread inlet section 4, a thread drawing device 6 and take-up reels 7 arranged downstream of the inlet godet roller pair 5 on a processing path of the thread production system 1.

Further embodiments of the thread production system 1 according to the invention (not shown here) with more than two workstations 2 or else just one single workstation 2 are easily possible.

Figure 2:
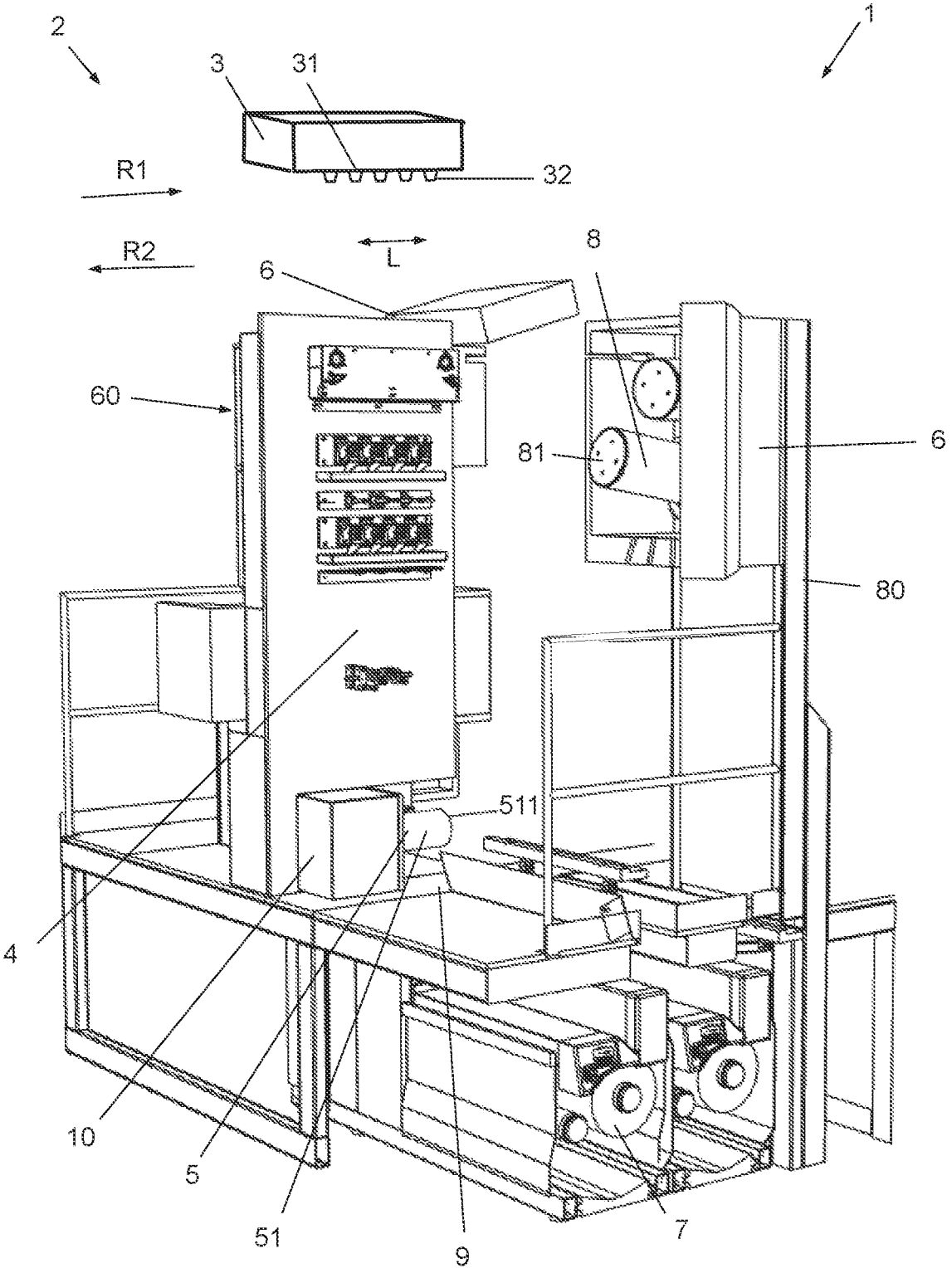
FIG. 2 schematically shows a workstation of the thread production system according to the invention from FIG. 1 in a front view.
Figure 3:
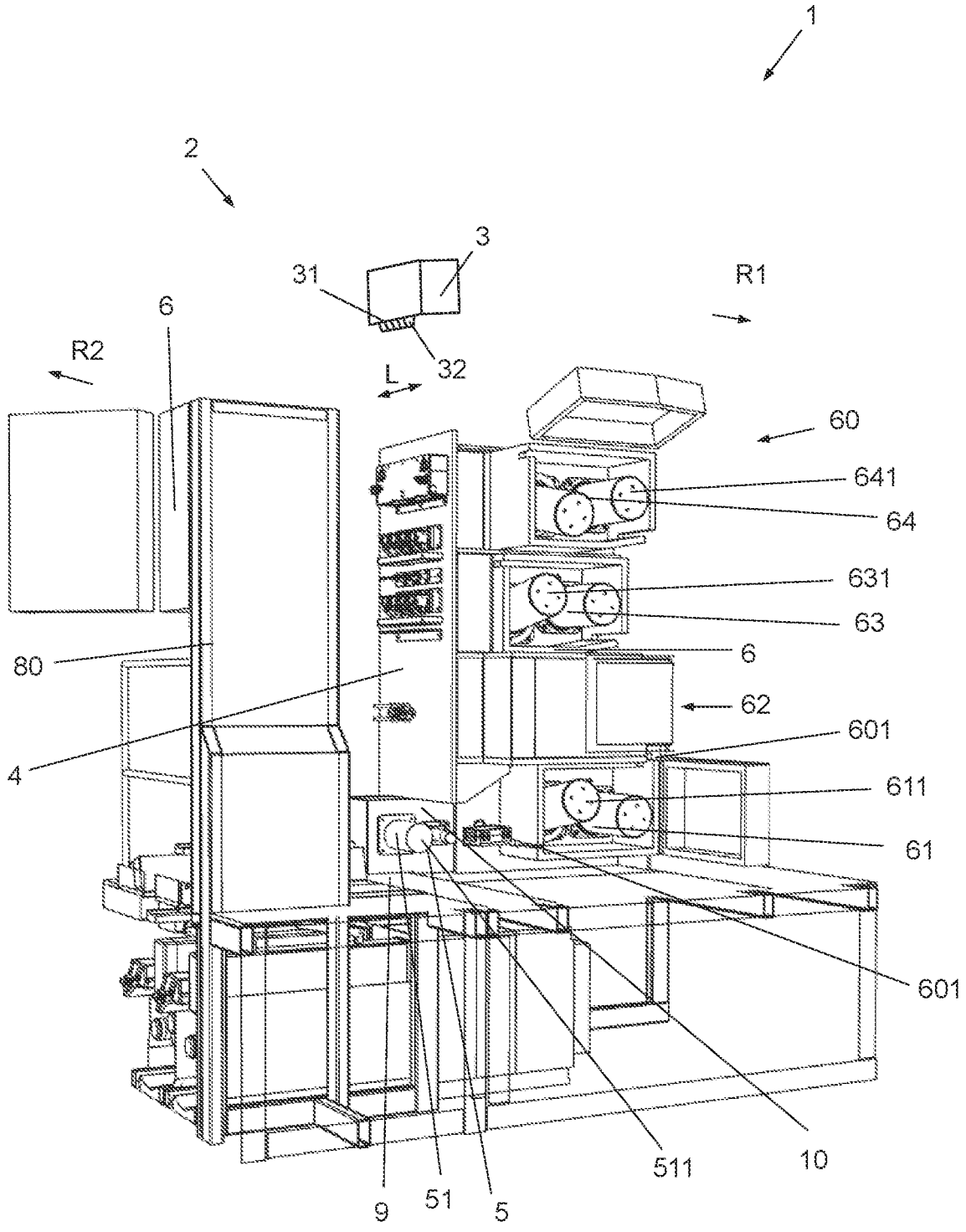
FIG. 3 schematically shows a workstation of the thread production system according to the invention from FIGS. 1 and 2 in a side view.
Figure 4:
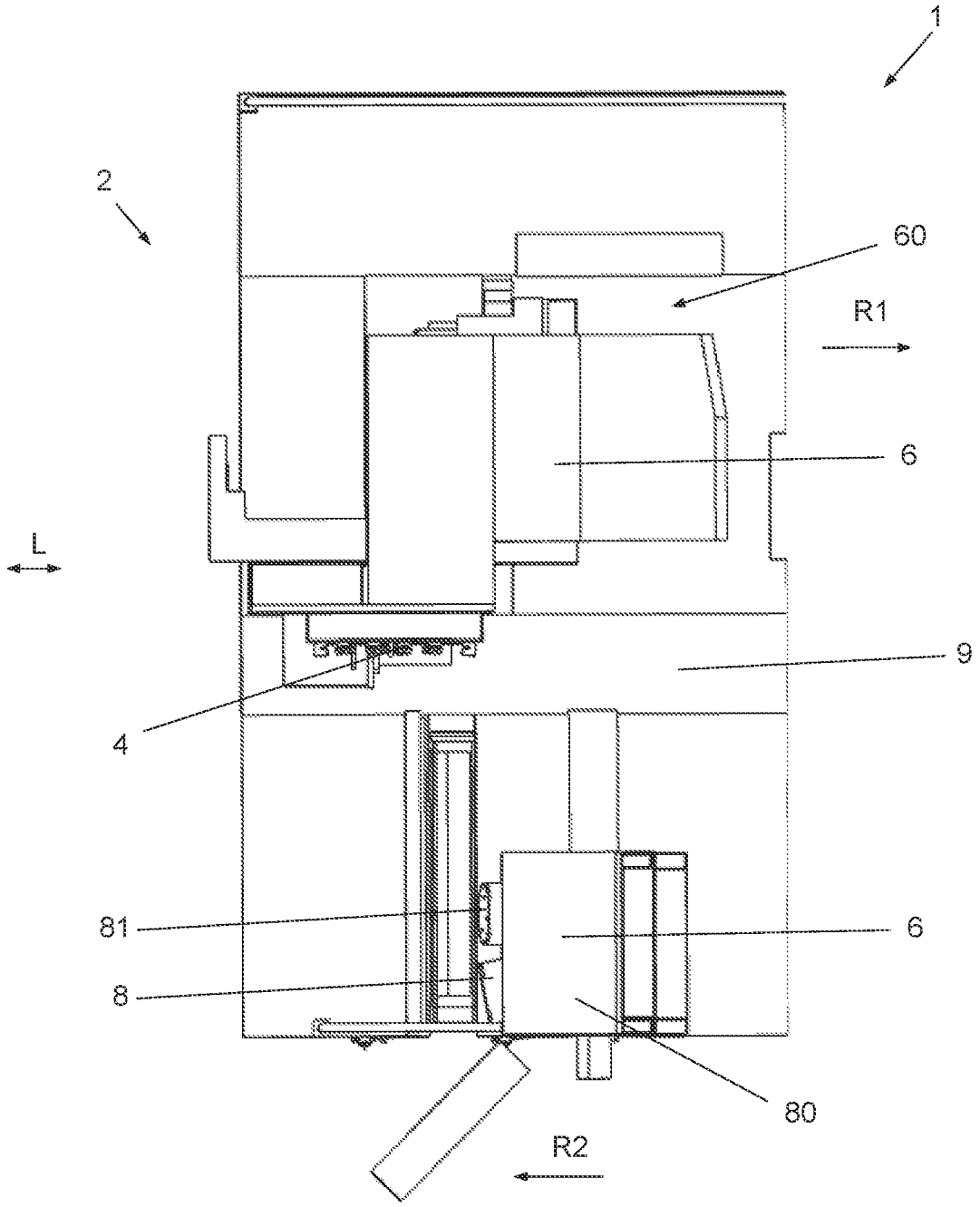
FIG. 4 schematically shows a workstation of the thread production system according to the invention from FIGS. 1 to 3 in a plan view.

In FIG. 1, as also in the other FIGS. 2 to 4, the melt-spinning devices 3 are shown in a greatly simplified and incomplete manner for the sake of clarity. In particular, extruders and filling devices are omitted in the figures. The melt nozzles 32 of the respective melt-spinning devices 3 are each arranged in a longitudinal direction L of a nozzle row 31.

For the further description of the embodiment of the invention shown here, it is expedient to consider only one individual workstation 2 of the thread production system 1.

FIGS. 2 to 4 each show a single workstation 2 of the thread production system 1 according to the invention from FIG. 1 in a front view (FIG. 2), a side view (FIG. 3) and a plan view (FIG. 4).

The filaments coming out of the melt nozzles 32 are cooled down as they come down and are combined by means of devices (not shown here) of the thread production system 1 to form threads which fall next to one another as a thread sheet into a thread inlet section 4 of the thread production system 1 and are pulled downwards at the bottom by the inlet godet roller pair 5 located at the lower end of the thread inlet section 4. The thread inlet section 4 runs along a vertical inlet section wall of the thread production system 1 arranged under the melt-spinning device 3.

The inlet godet roller pair 5 is attached to a drive module 10, which is located underneath the thread inlet section 4 and at least partially protrudes laterally from the retaining wall on which the thread inlet section 4 runs. A rotational axis of a first godet roller 51 of the inlet godet roller pair 5 is aligned parallel to the longitudinal orientation L of the nozzle row 31.

As can be seen in FIG. 2, the thread sheet can thus easily be routed—by an operator standing in front of the thread inlet section 4—around the first godet roller 51 of the inlet godet roller pair 5 on the processing path without the thread sheet having to be twisted around the processing direction.

Then, as can be seen in FIG. 3, the thread sheet is guided by the operator around hot godet roller pairs 61, 62, 63, 64 of the thread drawing device 6 which are fastened on top of one another on a drawing panel frame 60. The operator can get from the inlet godet roller pair 5 at the end of the thread inlet section 4 to a first hot godet roller pair 61 on the processing path via a passage 9.

The hot godet roller pairs 61, 62, 63, 64 are located in thermally insulating housings which are provided with slots 601 through which the thread sheet can run onto and off of the respective hot godet roller pairs 61, 62, 63, 64. The thermally insulating housings are shown in all figures in an open state.

Free godet roller ends 611 of the first hot godet roller pair 61 on the processing path protrude into the same first half space R1 as free godet roller ends 511 of the inlet godet roller pair 5. The thread sheet can thus be routed by the operator very advantageously from the inlet godet roller pair 5 around the first hot godet roller pair 61 of the thread drawing device 6.

Above the first hot godet roller pair 61 on the processing path, there is a second hot godet roller pair 62, the free godet roller ends of which protrude into a second half space R2 lying opposite the first half space R1. In FIG. 3, the second hot godet roller pair 62 is therefore also not visible. Only the rear side of the godet roller retaining wall, on which the drive ends of the godet rollers of the second hot godet roller pair 62 are fastened, can be seen.

In order to guide the thread sheet after winding the first hot godet roller pair 61 around the second hot godet roller pair 62, the thread sheet is guided through a slot 601 from the thermally insulating housing of the first hot godet roller pair 61 into the thermally insulating housing of the second hot godet roller pair 62. The operator can walk around the drawing panel frame 60 and then guide the thread sheet around the second hot godet roller pair 62. Then the thread sheet can be wound from there and in the same way around a third hot godet roller pair 63 above the second hot godet roller pair 62.

In the embodiment shown, the first three hot godet roller pairs 61, 62, 63 on the processing path that are arranged on the drawing panel frame 60 are arranged in each case in such a way that their free godet roller ends 611, 631 protrude from the hot godet roller pairs 61, 62, 63 arranged directly one after the other on the processing path into half spaces R1, R2 lying opposite one another.

In the embodiment of the thread production system 1 shown only by way of example, the drawing panel frame 60 has an uppermost hot godet roller pair 64, which protrudes into the same half space R1 as free godet roller ends 631 of a hot godet roller pair 63 arranged underneath.

The operator can transfer the thread sheet either from the third hot godet roller pair 63 directly to a heated relaxing godet roller pair 8 arranged on a separate relaxing frame 80 or first wrap it again around the uppermost hot godet roller pair 64 of the drawing panel frame 60. As a result, by simply loading the thread sheet, the number of hot godet roller pairs 61, 62, 63, 64 used for drawing the threads can be increased by one or reduced by one. Thus, different types of threads can be produced on one and the same workstation 2 of the thread production system 1 according to the invention, without a changeover thereof being necessary for this purpose. The uppermost hot godet roller pair 64 can thus optionally be included in the thread production.

The uppermost hot godet roller pair 64 projects by at least half of a godet roller casing length of one of its godet rollers over the free godet roller ends 631 of the hot godet roller pair 63 arranged underneath into the respective, identical half space R1. As a result the thread sheet, after running off from the free godet roller ends 631 of the third godet roller pair 63 close to the driving ends of the optional uppermost hot godet roller pair 64 can run onto the uppermost hot godet roller pair 64.

On the processing path to the hot godet roller pairs 61, 62, 63, 64 of the drawing panel frame 60, the thread sheet then continues to run over the heated relaxing godet roller pair 8, which is fastened to the separate relaxing frame 80 in the exemplary embodiment of the invention shown in FIGS. 1 to 4.

Free ends 81 of the relaxing godet roller pair 8 protrude into a second half space R2 lying opposite the first half space R1. In other words, the free ends 81 of the relaxing godet roller pair 8 and the free ends 51 of the inlet godet roller pair 5 protrude in spatial direction regions lying opposite one another and are thus easily reached by the operator from the passage 9 formed between the relaxing frame 80 and the drawing panel frame 60. The operator can route the thread sheet from the third hot godet roller pair 63 and as well as from the uppermost hot godet roller pair 64 through the passage 9 to the relaxing godet roller pair 8.

The horizontal and vertical offset between a thread outlet from the third hot godet roller pair 63 and a thread outlet from the uppermost hot godet roller pair 64 does not cause any significant difference for a thread inlet on the relaxing godet roller pair 8, since the inlet angles are virtually the same in both cases because of a sufficiently large distance due to the passage 9 between the relaxing frame 80 and the drawing panel frame 60.

In the exemplary embodiment shown, two take-up reels 7 are located below the relaxing frame 80. After passing through the relaxing godet roller pair 8, the thread sheet is singulated into individual threads and these are wound onto the take-up reels 7.

As a result, the embodiment shown in FIGS. 1 to 4 represents a compact thread production system 1 which is easily accessible for a thread change and in which the thread sheet is not twisted in its width orientation either in the case of a thread change or in the course of the thread drawing process, apart from the slight twists which are due to the necessary oblique arrangement of a single godet roller within a godet roller pair.

The invention claimed is:

1. A thread production system, comprising:

a drawing panel frame;

at least one workstation having, in each case one after another on a processing path, a melt-spinning device with a plurality of melt nozzles disposed in a longitudinal orientation of a nozzle row, a thread inlet section, an inlet godet roller pair with free godet roller ends and disposed at an end of said thread inlet section, a thread drawing device with at least two hot godet roller pairs disposed on said drawing panel frame of the thread production system, and at least one take-up reel, and said thread drawing device being arranged laterally next to said thread inlet section;

wherein a first hot godet roller pair of said at least two hot godet roller pairs is disposed on the processing path upstream of a second hot godet roller pair and has free godet roller ends which, in a front view of the thread production system, said free godet roller ends of said inlet godet roller pair and said free godet roller ends of said first hot godet roller pair protrude into an identical first half space as said free godet roller ends of said inlet godet roller pair;

said second hot godet roller pair is disposed above said first hot godet roller pair on the processing path;

wherein a rotational axis of a first godet roller of said inlet godet roller pair is oriented at an angle of from 0° to 45° with respect to the longitudinal orientation of said nozzle row, wherein said first godet roller of said inlet godet roller pair is disposed on the processing path upstream of a second godet roller of said inlet godet roller pair;

a relaxing frame disposed on the processing path downstream of said drawing panel frame; and a heated relaxing godet roller pair disposed on said relaxing frame, wherein said drawing panel frame and said relaxing frame have a passage formed therebetween, such that an operator can stand on said passage and rotate and walk along said passage formed between said relaxing frame and said drawing panel frame, and wherein said heated relaxing godet roller pair have free ends protruding into a second half space lying opposite the first half space.

2. The thread production system according to claim 1, wherein at least two of said hot godet roller pairs are disposed directly one after another on the processing path and are disposed such that their said free godet roller ends protrude into said first and second half spaces lying opposite one another.

3. The thread production system according to claim 2, wherein all of said hot godet roller pairs disposed on said drawing panel frame are each disposed such that their respective said free godet roller ends protrude from said hot godet roller pairs, which are disposed directly one after another on the processing path, into said first and second half spaces lying opposite one another.

4. The thread production system according to claim 2, wherein only said free godet roller ends of an uppermost hot godet roller pair of said hot godet roller pairs of said drawing panel frame protrude into a same half space as said free godet roller ends of a hot godet roller pair arranged underneath said uppermost hot godet roller pair, wherein said uppermost hot godet roller pair protrudes through at least half of a godet roller casing length of one of its godet rollers over said free godet roller ends of said hot godet roller pair arranged underneath into a respective, identical half space.

5. The thread production system according to claim 1, further comprising a drive module, said inlet godet roller pair is attached to said drive module disposed under and at least partially in front of said thread inlet section.

* * * * *